US010969090B1

(12) United States Patent
Novakovic

(10) Patent No.: US 10,969,090 B1
(45) Date of Patent: Apr. 6, 2021

(54) SURFACE MOUNTED LIGHTING SYSTEMS PREFERABLY FOR USE AS CEILING LIGHTING

(71) Applicant: Novak Novakovic, Toronto (CA)

(72) Inventor: Novak Novakovic, Toronto (CA)

( * ) Notice: Subject to any disclaimer, the term of this patent is extended or adjusted under 35 U.S.C. 154(b) by 0 days.

(21) Appl. No.: 16/773,970

(22) Filed: Jan. 27, 2020

(51) Int. Cl.

| | |
|---|---|
| ***F21S 8/00*** | (2006.01) |
| ***F21V 23/00*** | (2015.01) |
| ***F21V 23/04*** | (2006.01) |
| ***F21S 8/04*** | (2006.01) |
| ***F21V 21/08*** | (2006.01) |
| ***F21V 15/01*** | (2006.01) |
| *F21Y 105/18* | (2016.01) |
| *F21Y 115/10* | (2016.01) |

(52) U.S. Cl.
CPC ..... *F21V 23/001* (2013.01); *F21S 8/033* (2013.01); *F21S 8/046* (2013.01); *F21V 15/01* (2013.01); *F21V 21/0808* (2013.01); *F21V 23/003* (2013.01); *F21V 23/0435* (2013.01); *F21Y 2105/18* (2016.08); *F21Y 2115/10* (2016.08)

(58) Field of Classification Search
CPC ..... F21V 23/001; F21V 23/003; F21V 15/01; F21V 23/0435; F21V 21/0808; F21S 8/046; F21S 8/033; F21Y 2105/18; F21Y 2115/10
See application file for complete search history.

(56) References Cited

U.S. PATENT DOCUMENTS

| | | | | |
|---|---|---|---|---|
| 6,183,104 | B1 * | 2/2001 | Ferrara | F21S 2/005 362/145 |
| 6,492,595 | B2 * | 12/2002 | Sexton | H01R 25/16 174/117 F |
| 7,429,186 | B2 * | 9/2008 | Mrakovich | H01R 13/7175 439/404 |
| 2005/0042942 | A1 * | 2/2005 | Sexton | G06K 7/00 439/884 |

* cited by examiner

*Primary Examiner* — Tracie Y Green
(74) *Attorney, Agent, or Firm* — Daniel S. Polley, P.A.

(57) ABSTRACT

A surface mounted lighting is disclosed and includes a pair of copper foils/strips extending along a length of a removable guide tape. The copper strips are provided with adhesive on their opposite side for securement to the intended surface (e.g. ceiling, wall, etc.) in a room. One or more lights can be adhered to the surface secured copper tape, after the guide tape is removed, to create an electrical connection/communication between the tape and light(s). An electrical controller can also be adhered to the copper tape preferably similar to how the lights are secured to the copper tape to create an electrical connection/communication between the electrical controller and the copper tape and for sending power to the light(s) when the electrical controller is turned on or otherwise instructed. The electrical controller is preferably electrically connected to an electrical outlet within the room for receiving power. The disclosed lighting system is safely and easily installed without any drilling into walls or ceilings.

20 Claims, 6 Drawing Sheets

SURFACE MOUNTED LIGHTING SYSTEMS PREFERABLY FOR USE AS CEILING LIGHTING

FIELD OF THE DISCLOSURE

The disclosure relates generally to lighting systems and more particularly to a surface mounted lighting systems.

BACKGROUND

With conventional "pot light" and other ceiling lighting systems, installation typically requires drilling and hammering items into the ceiling and wall, and usually requires a professional electrician to perform the installation. What is needed is a ceiling lighting system that can be easily and quickly installed without tools and drilling that can be manually installed by the homeowner without the need for hiring a professional electrician. The below described novel surface mounted electrical device/lighting system is directed to overcoming the above issues with installation of current ceiling lighting systems.

SUMMARY OF THE DISCLOSURE

A novel surface mounted electrical device system is disclosed, which in one non-limiting embodiment can be a lighting system having a pair of copper foils/strips ("copper strips") extending along a majority of, if not the entire, length of a removable guide tape. The copper strips are provided with adhesive on their opposite side for securement to the intended surface (e.g. ceiling, wall, etc.) in a room. One or more lights (e.g. 12V LED light) can be adhered to the surface secured copper tape, after the guide tape is removed, to create an electrical connection/communication between the tape and light(s). An electrical controller can also be adhered to the copper tape preferably similar to how the lights are secured to the copper tape to create an electrical connection/communication between the electrical controller and the copper tape and for sending power to the light(s) when the electrical controller is turned on or otherwise instructed. Though the electrical controller is preferably electrically connected to an electrical outlet within the room for receiving power, it is also within the scope of the disclosure that the electrical controller can also be powered by battery (rechargeable and/or non-rechargeable battery (ies)). Though optional, a remote controller can also be preferably provided for allow the user to remotely and wirelessly electrically communicate with the electrical controller to operate the lighting system.

Though not considered limiting, the disclosed system is preferably for use as a ceiling lighting system. Other non-limiting examples of electrical devices that can be mounted, with or without the lights also mounted, include a ceiling fan, audio speakers, security cameras, etc.

The disclosed lighting system allows a user to relatively quickly, safely and easy manually install a lighting system in a room without any drilling into the walls or ceilings of the room and without having to hire a professional electrician.

DETAILED DESCRIPTION

Figure 1:
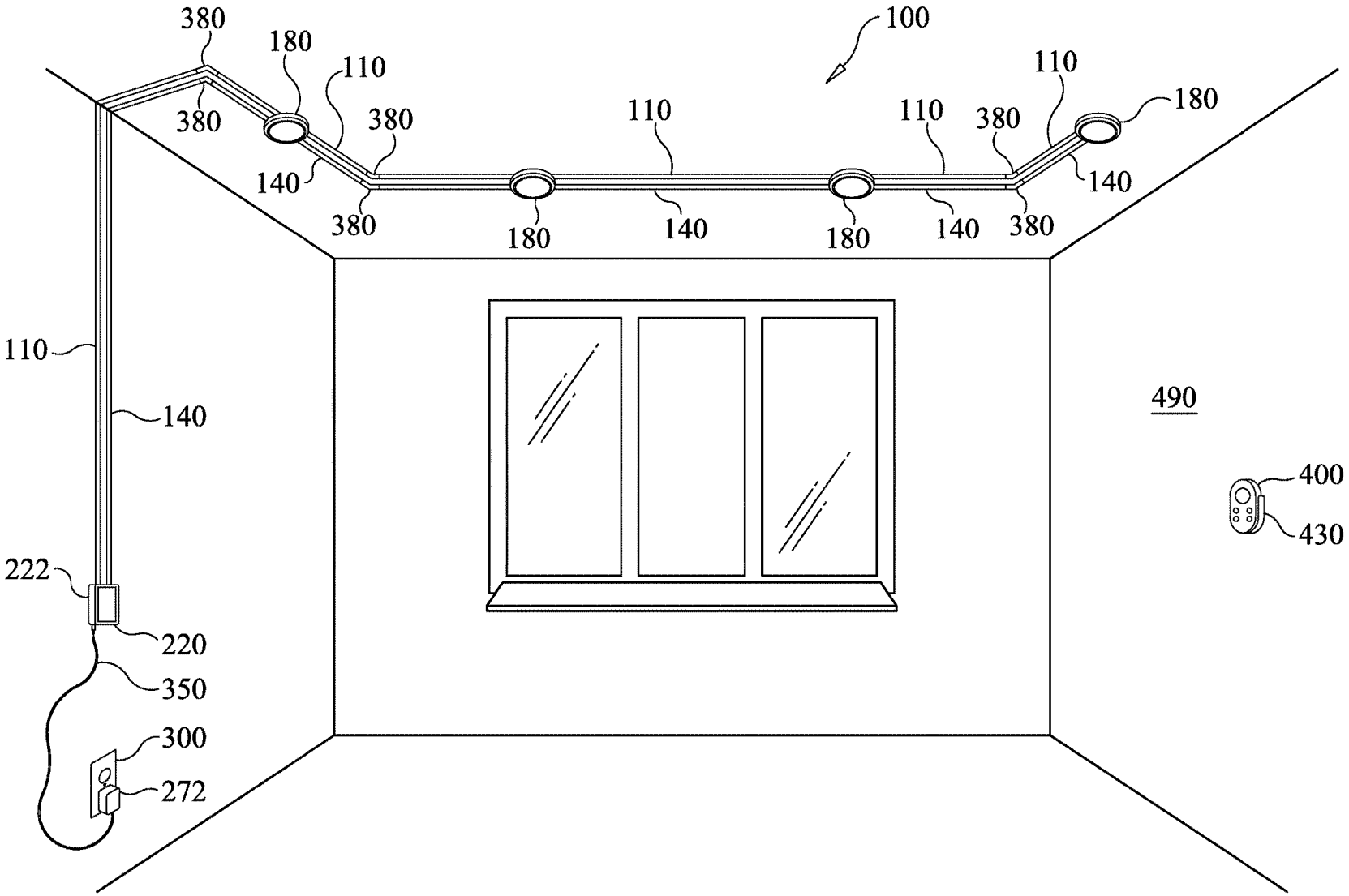
FIG. 1 is a perspective view of one embodiment for the surface mounted lighting system in accordance with the present disclosure.

As seen in the drawing figures, a novel surface mounted lighting/electrical device system is shown and generally designated lighting/electrical device system 100 (collectively "lighting system 100"). In a preferred non-limiting embodiment, lighting system 100 can comprise a first strip or length of conductive material, a second strip or length of conductive material, one or more electrical devices in electrical communication with the first conductive strip and the second conductive strip and an electrical device controller also in electrical communication with the first conductive strip and the second conductive strip.

Though not considered limiting, the first conductive strip can be a length of a copper member/copper tape/copper foil 110 (collectively "copper strip 110") and the second conductive strip can be a length of a copper member/copper tape/copper foil 140 (collectively "copper strip 140").

The electrical device can be one or more lights 180, a ceiling fan, audio speakers, etc., or a combination thereof, which are in electrical communication with copper strip 110 and copper strip 140. Though preferably the audio speakers are wireless (i.e. Bluetooth communication), it is within the scope of the disclosure to include wired speakers also with system 100. Additional mounting connecter/holders would also be preferably provided for securing a ceiling fan give the additional weight considerations of a fan as compared to the weight of light 180.

As mentioned above, the electrical device/light controller 220 is also in electrical communication with copper strip 110 and copper strip 140. As seen in FIG. 1, light controller 220 can be preferably powered by a conventional AC outlet 300 using a conventional electrical cord 350 or can alternatively be battery powered (rechargeable or non-rechargeable battery(ies)). Thought the disclosure includes the use of a single light 180, as seen in FIG. 1 in many applications a plurality of lights 180 will be used and incorporated for lighting system 100.

Preferably, an optional remote controller 400 can be provided for wireless communication with light controller 220 to control lighting system 100. Though not considered limiting, remote controller 400 can be used to turn the one or more lights 180 "on" and "off", as well as for dimming and/or controlling the brightness of light(s) 180. A remote holder 430 can be provided and mounted to a wall 490 or other surface for holding or storing remote controller 400. In an alternative embodiment (or in addition to providing remote controller 400), one or more control buttons can be provided and accessed by a user directly on light controller 220 for controlling light(s) 180.

Figure 7:
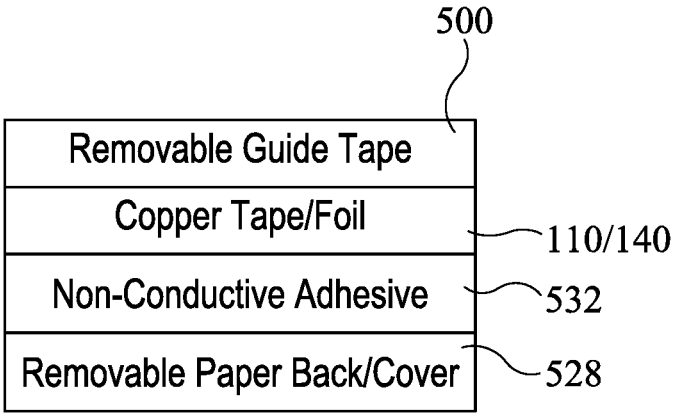
FIG. 7 is a side view of guide tape with copper strips/tape prior to installation to the surface in accordance with the present disclosure, with the multiple layers enlarged for illustrative purposes only.

Preferably, copper strip 110 and copper strip 140 can be provided together on a piece of corresponding length of adhesive tape 500, with strips 110 and 140 spaced apart in a preferred parallel relationship to each other. Tape 500 (containing strips 110 and 140) can be provided in a roll form. In one non-limiting installation method, a user/installer can roll a desired length of tape needed and cuts such length from the remaining roll. Tape 500 preferably provides the preferred mechanism for securing the associated copper strips/tape 110 and 140 to the surface (e.g. ceiling, wall, etc.). Tape 500 acts as a guide for strips 110 and 140 to help ensure that strips 110 and 140 are secured to the surface at a preferred consistent distance 113 (i.e. substantially parallel) between strips 110 and 140. As seen in FIG. 7, in addition to tape 500, and strips 110 and 140, the roll also preferably includes a releasable/removable cover 528 (preferably constructed from paper though not considered limiting) disposed over the strips 110 and 140, while the strips are rolled up as part of the roll for tape 500. The removable cover 528 is removable secured to and over strips 110 and 140 by an adhesive 532 disposed on side 112 and 142 of strips 110 and 140, respectively. Preferably, adhesive 532 can be non-conductive. Guide tape 500 can be removably/releasably secured to strips 110 and 140 also be an adhesive. A single cover 528 can be provided that covers both strips 110 and 140, or each strip can be provided with its own cover 528.

To install strips 110 and 140, after unrolling a desired length of guide tape 500 with strips 110 and 140 and cover paper(s) 528 or cutting such desired length from the roll, cover paper(s) 528 is removed (i.e. pulled off) exposing adhesive 532 (preferably nonconductive) to allow strips 110 and 140 to be secured to (i.e. stuck on, etc.) the desired surface (e.g. ceiling, wall, etc.). At this point, associated length of tape 500 is preferably still secured to strips 110 and 140. With strips 110 and 140 properly secured, the user than removes the length of tape 500 to expose and make accessible the other side 114 and 144 (i.e. previously covered by tape 500) of strips 110 and 140, respectively, for securement of light 180 or other electrical device and/or controller 220, which will be discussed in more detail below. Preferably, tape 500 can be clear, transparent or translucent, though such is not considered limiting.

Figure 2:
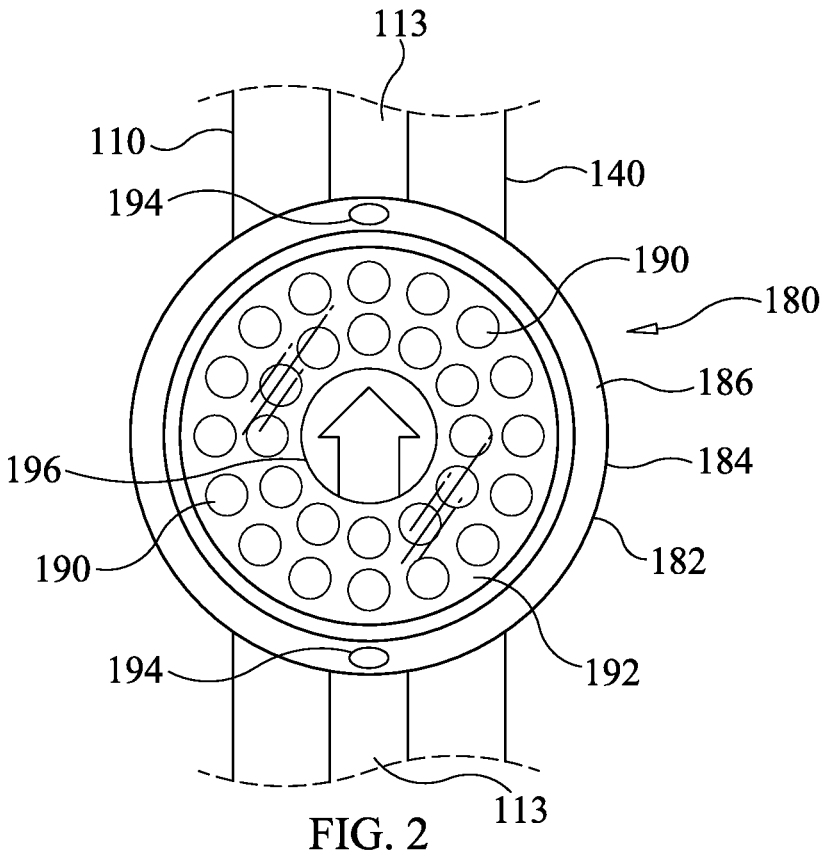
FIG. 2 is a front view of a non-limiting light embodiment shown secured/electrically connected to the copper strips of the surface mounted lighting system with the copper strips secured to the surface and after the guide tape has been pulled off the copper strips in accordance with the present disclosure.

In one non-limiting embodiment the electrical device to be secured to the copper strips can be one or more lights, such as light 180 (See FIG. 2). Though shown having round shaped housing, the housing shape for light 180 can be any shape desired in addition to round and all shaped are considered within the scope of the disclosure. As seen in FIG. 2, light 180 can include a housing member 182 having an outer perimeter 184 (having an outer surface 186) and a back surface 188 (see FIG. 3), one or more and preferably a plurality of bulbs 190 (preferably LED bulbs, though not considered limiting) and conventional electrical/light circuitry disclosed within housing 182. A clear, transparent or translucent cover 192 can be provided over bulb(s) and preferably is secured to outer perimeter 184. One or more removable dots or other removable markings 194 can be secured to light 180 and are shown as preferably two stickers that can be removably secured to surface 186. An electric flow marking 196 can also be secured to light 180 and is shown as preferably a removable arrow sticker pointing in a specific direction/position that light 180 should be secured to strips 110 and 140 to ensure proper electrical flow. Though not considered limiting, as seen in FIG. 2, flow marking 196 can be an arrow sticker and can be removably secured to cover 192. Markings 194 are used to also properly position light 180 with respect to strips 110 and 140. Thus, when markings 194 are preferably positioned to line up with distance 113 between strips 110 and 140 (See FIG. 2) the contact members on back surface 188 of light 180 will be properly aligned with strips 110 and 140 to allow the contact members to make a proper electrical connection with strips 110 and 140 when light 180 is secured to strips 110 and 140. Once light 180 is secured, markings 194 and flow marking 196 (i.e. preferably stickers) can be removed from light 180. Similar removable positioning markings 194 and flow marking 196 can also be provided on controller 220 for aiding in properly securing controller 220 to the intended surface. Preferably, the direction of the arrow/flow marking used for controller 220 can be the same direction for arrow/flow marking 196 fused or each light 180, particularly where the strips 110/140 for a single line (i.e. without intersections of strips, etc.).

Figure 3:
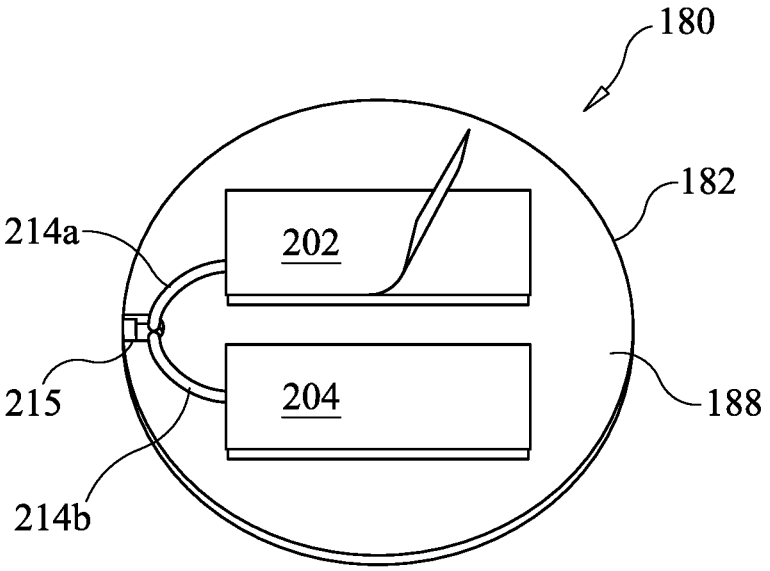
FIG. 3 is a back view of a non-limiting light embodiment showing the contacts for the light that contact the copper strips in accordance with the present disclosure.
Figure 6:
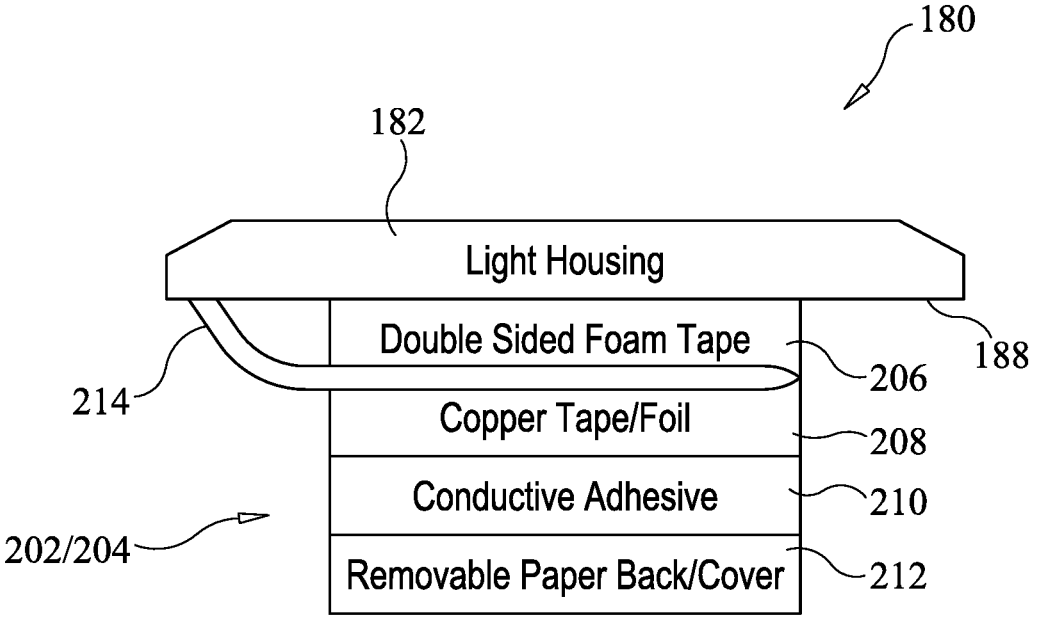
FIG. 6 is a side view of the non-limiting light embodiment emphasizing the multiple layers for the contacts of FIG. 3 in accordance with the present disclosure, with the layers enlarged for illustrative purposes only.

FIG. 3 and FIG. 6 illustrate a back and side, respectively, for a preferred non-limiting embodiment for light 180, when the electronic device is a light. As seen, contact member 202 and 204 are provided on back surface 188. Depending on the proper orientation of light 180 in a particular designed lighting system, contact member 202 either makes electrical contact and connection with strip 110 or 140, and contact member 204 makes electrical contact with the other strip not contacted by contact member 202, either 140 or 110, respectively. As mentioned above, lining up markings 194 and flow marking 196 when attaching light 180, ensures the contact member 202 makes electrical contact with the proper conductive strip 110/140 and that contact member 204 makes electrical contact with the other conductive strip 140/110.

Each contact member 202 and 204 are preferably multi-layered and constructed similar to each other, such that the description for the layers of contact member 202, also apply for contact member 202. Additionally, the back surface of controller 220 also contains a pair of similar contact members for electrically connecting controller 220 to strips 110 and 140, such that the discussion of the layers for contact member 202 is also applicable for the description of the contact members of controller 220. The permanent layers making up the contact member can comprise foam tape 206 (preferably double sided, though not limiting), a conductive member (preferably in the non-limiting form of copper tape/foil 208 and conductive adhesive 210. Prior to attaching light 180 or controller 220, a removable cover 212 (preferably in the non-limiting form of a removable paper cover) can be provided over conductive adhesive 210, such that the adhesive of conductive adhesive is protected and not exposed prior to use. When light 180 (or controller 220) is to be attached to the surface, paper cover 212 is removed to expose conductive adhesive 210 and allow such adhesive to secure light 180 or controller 220 to the surface.

The foam strips 206 of contact members 202 and 204 can be attached to back surface 188 by conventional means (i.e. adhesive, glues, tapes, etc.) and can be preferably positioned side by side to each other. Contact members 202 and 204 provide for a "positive" and "negative" electrical connection for light 180 (or other electrical device) with the copper strips 110 and 140 secured to the surface. Preferably, the space between contact members 202 and 204 is the same or similar to space/distance 113 between strips 110 and 140 disposed on the surface. The double-sided copper tape 208 on top of foam strips 206 can be provided with conductive adhesive on both sides, with a portion of wire 214*a* or 214*b* sandwiched in between foam 206 and copper 208. Wires 214*a* and 214*b* preferably deliver electrical energy for running the preferred LED light 180 or other electrical device and communicate with a positive and negative electrical connection on the circuit board within light 180 or controller 220. One wire 214*a* or 214*b* is electrically connected (e.g. soldered, etc.) to the positive connection and the other wire 214*b* or 214*a* is electrically connected to the negative connection. The opposite ends of wire 214*a* and 214*b* are electrically connected with associated contact members 202 and 204. Preferably, the left positioned contact member (i.e. using arrow marking 196 as a positional basis) can be designated or configured for the negative connection.

As mentioned above, release paper 212 is pulled off from both contact members 202 and 204 (i.e. either separate release papers for each contact member or a single larger release paper covering both contact members) or otherwise removed when installing light 180, and light 180 can then be stuck to or onto the installed copper tape/strips 110 and 140.

A first surface of foam tape 206 is adhered or otherwise secured to back surface 188 of light 180. The conductive member (e.g. copper tape 208) is attached to other opposite surface of foam tape 206 with a second end portion of electrical wire 214*a* sandwiched between conductive member 208 and foam tape 206 of first contact member 202 and with a second end portion of electrical wire 214*b* sandwiched between conductive member 208 and foam tape 206 of second contact member 204, such that electrical wires 214*a* and 214*b* are in electrical connection and communication with their associated conductive member 208. The first opposite end portion of electrical wire 214 can be contained within light housing 182 and electrically connected to the light circuitry/electronics/circuit board contained within light housing. Preferably, a hole or opening 215 can be provide in back surface 188 or another area of light housing 182 to allow wire 214 to extend out of light housing 182 and make contact with conductive member 208.

Conductive adhesive 210 is provided over the outer surface of conductive member 208 and helps to ensure a proper electrical communication/connection between conductive member 208 and either conductive strip 110 or 140, when light 180 or controller 220 is secured to the surface, in addition to securing the electrical devices (e.g. lights 180, etc.) and controller 220 to the surface.

As referenced above, the preferred LED lights of lights 180 can be controlled through controller 220 which is also electrically connected to conductive strips 110 and 140 similar to how lights 180 are connected. Where the system is used with other electrical devices (e.g. ceiling fan, audio equipment, security cameras, etc.), controller 220 can be used for controlling such other electrical devices. Thus, controller 220 also includes a housing 222 and has similar contact members 202 and 204 on a back surface of housing 222, similar to light 180. The controller contact members are thus also preferably side by side and represent the "positive" and "negative" for the electrical circuit. The above description of the preferred multi layers contact members 202 and 204 for light 180 also applies to the description for the preferred multi layers contact member 202 and 204 for controller 220. Accordingly, the contact members for light 180 and for controller can be constructed and function operate similarly/identically. Also, similar to light 180, an output electrical wire will be sandwiched in the multi-layer contact members for controller 220 at one end and will be in communication with the controller circuitry/electronics disposed within controller housing 222 at its opposite second end. As such, when installing controller 220, the release paper is pulled off contact members 202 and 204 to expose the conductive adhesive which is used to stick controller 220 on the previously copper tape/conductive strips 110 and 140. Once completed, a preferred 120V to 12V AC to DC adaptor 272 can be conventionally plugged into an electrical outlet 274 and through an electrical cord 276 running from adaptor 272 plugged into or connected with controller 220 to provide for an electrical connection between 272 and controller 220. By using adaptor 272, system 100 can be a 12V low voltage electrical device/lighting system 100. Accordingly, in a first preferred embodiment, a surface mounted low-voltage (e.g. 12V DC, etc.) LED lighting kit can be provided. In an alternative embodiment, controller 220 can be powered by one or more batteries (rechargeable or nonchargeable) as opposed to powering controller 220 through an existing electrical outlet and requiring adaptor 272 to convert the voltage to low DC voltage.

One or more control buttons can be provided directly on controller 220 for controlling operation of light 180 or other electronic device and/or a remote controller 400 can be provided for sending commands remotely to controller 220 by a user for controlling operation of light 180 (i.e. on, off, dimness level, strobing, flashing etc.) or other electric device mounted through system 100. Remote controller 400 communicates with controller 220 through conventional electronic communication/wireless technologies and all are considered within the scope of the disclosure. An optional remote-control holder 430 can also be provided and preferably also surface mounted to provide for safe storage of remote control 400, while also making it easy to find remote control 400 when needed. Remote control 400 can be preferably used/operated while stored in holder 430 or can also be removed from holder 430 and similarly used/operated. Any conventional technology now known or later developed can be used for providing electrical communication (i.e. wireless) between remote controller 400 and controller 220.

Figure 4:
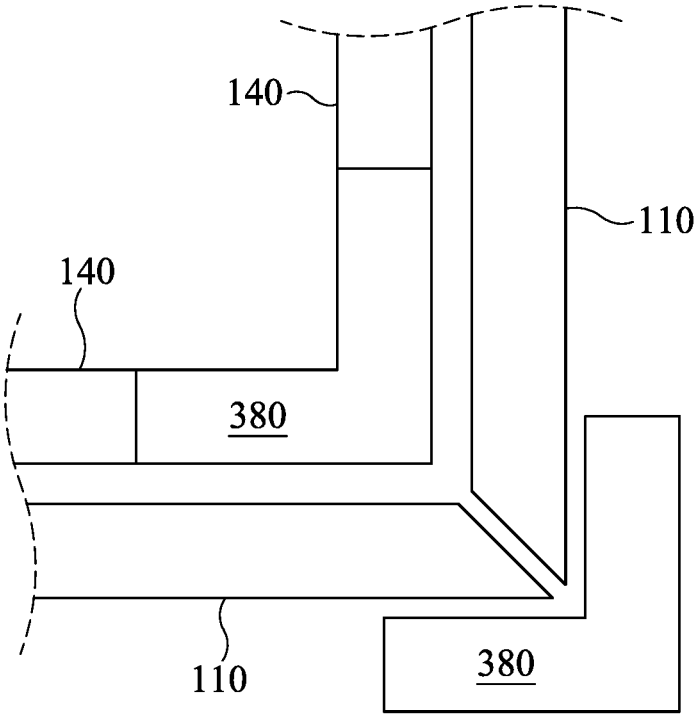
FIG. 4 is a close-up plan view of a corner member used for connecting adjacent copper strips at a corner turn for the layout of the copper strips in accordance with the present disclosure.

An optional triangle or similar shaped member can be provided and used as a tool for the user when cutting an end of guide tape 500, with strips 110 and 140. The triangle member aids the user in cutting tape 500 and strips 110 and 140 at the proper angle (i.e. 45°, 135°, etc.) so that the end can be positioned with a similar shaped end of an adjacent tape 500 (strips 110 and 140) (See FIG. 4) when creating a corner turn 370 for lighting system 100. Additionally, other aids or different angled member can also be provided to help in cutting tape 500 at other desired angles. For a ninety (90°) degree turn/relationship between adjacent lengths of strips 110 and/or 140, a conductive or copper corner member 380 (See FIG. 4—right angle corner member shown) can be preferably provided and disposed over the corners to ensure that an electrical connection is maintained between the adjacent strips. The materials used for copper corner member 380 can be similarly or the same as those used for strips 110 and 140.

Figure 5:
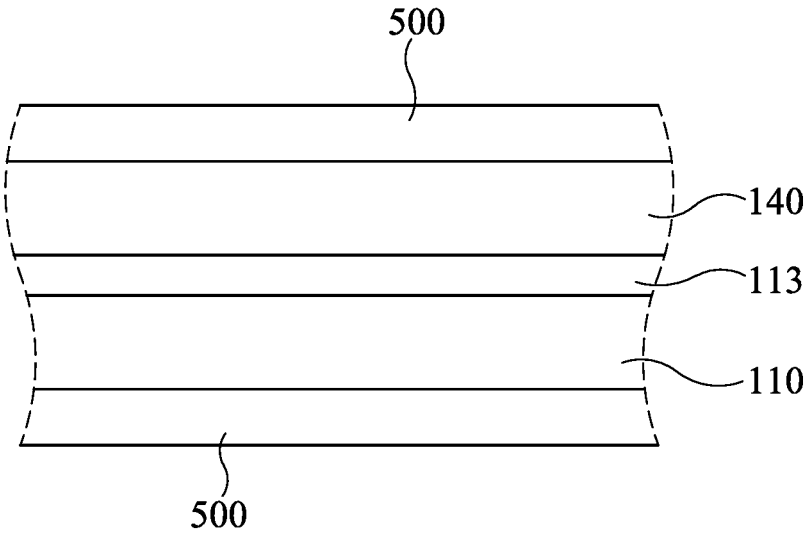
FIG. 5 is a front plan view of a portion of a length of tape containing the pair of copper strips in accordance with the present disclosure.

FIG. 5 illustrates a section of guide tape 500 with strips 110 and 140 maintained thereon in a preferred spaced apart and parallel relationship to each other.

Figure 8:
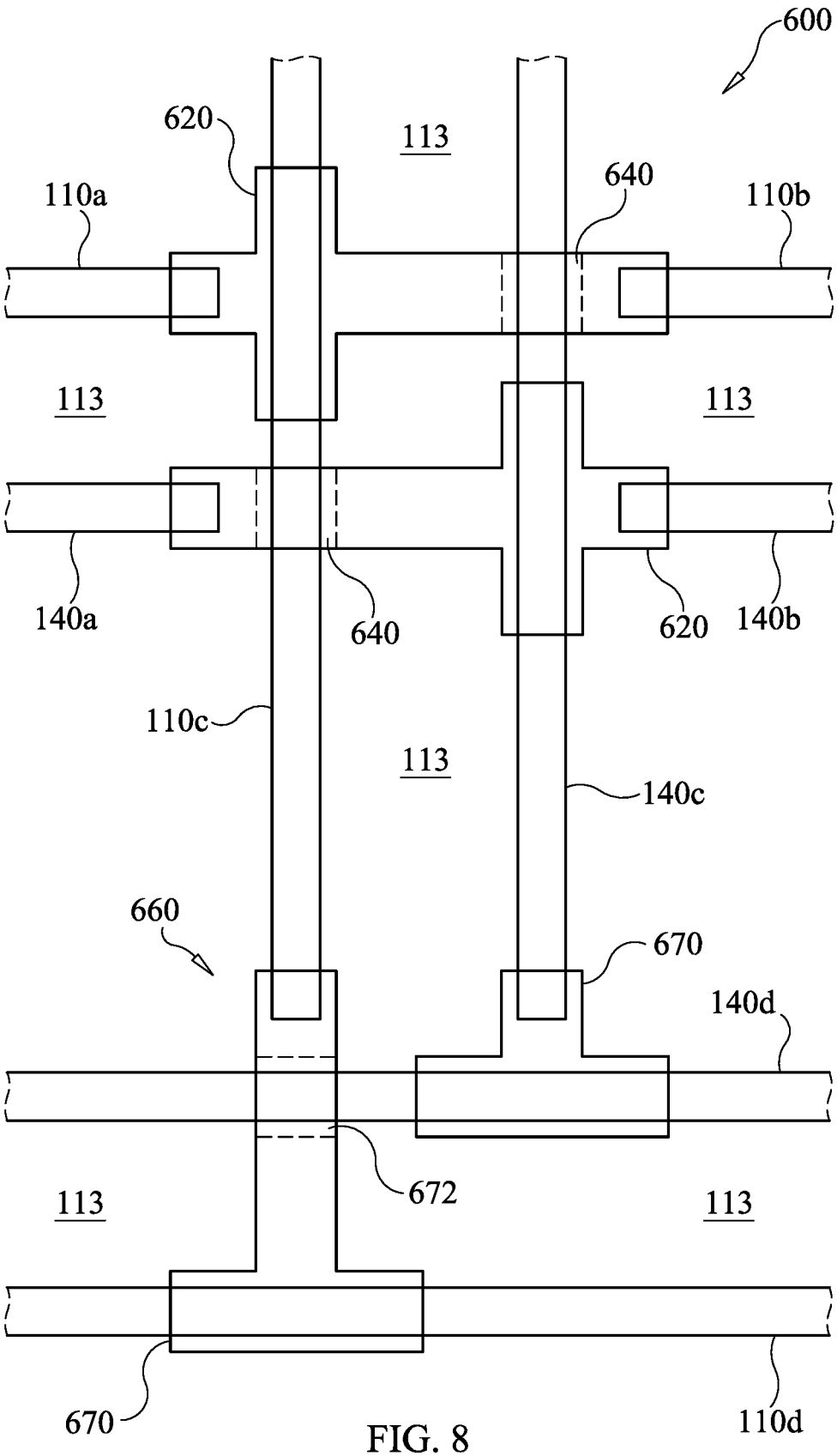
FIG. 8 illustrates a more elaborate copper strips pattern for the lighting system including a "plus" shaped copper strip intersection and a "T" shaped copper strip intersection and the use of cross shaped and T shaped member having insulating portions for proper electrical connection of the various copper strips at the intersections in accordance with the present disclosure.
Figure 9:
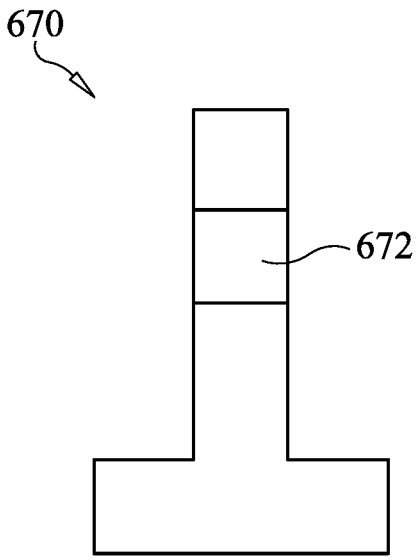
FIG. 9 illustrates a bottom view of one non-limiting "T" shaped member and showing the insulated portion in accordance with the present disclosure.
Figure 10:
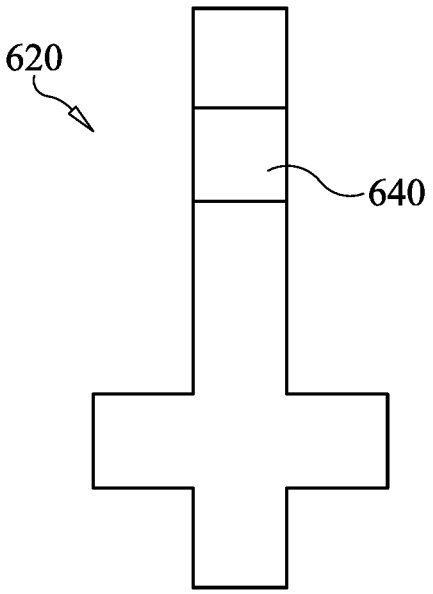
FIG. 10 illustrates a bottom view of the plus/cross shaped member and showing the insulated portion in accordance with the present disclosure.

FIG. 8 illustrates a more elaborate non-limiting conductive strip pattern for system 100 and shows a plus (+) shaped intersection 600 and T shaped intersection 660 non-limiting examples, with each form from several adjacent strips 110 and 140. For the "plus" shaped intersection example, one strip 110*a* or 140*a* needs to be electrically connected to another strip 110*b* or 140*b*, but a different strip 110*c* or 140*c* is positioned between strips 110*a* and 110*b* or 140*a* and 140*b*. There an electrical connector, similar in operation to corner member 380 needs to be provided to electrically connect strips 110*a* and 110*b* or strips 140*a* and 140*b* to each other, while at the same time not electrically connecting dissecting strip 110*c* or 140*c* so as to prevent shorting of the circuit. For the plus intersection 600 a plus, cross or similar shaped electrical/conductive connector member 620 (see FIG. 10) can be provided and is provided with an insulation portion 640 (e.g. paper, other insulating material, etc.) that is positioned over the particularly dissecting strip 110*c* or 140*c* needing to be avoided (i.e. not electrically connected). As seen in FIG. 8, one plus/cross shaped connector 620 insulates dissecting strip 110*c* and a second plus/cross shaped connector 620 insulates dissecting strip 140*c* and they provide the cross over electrical connections between strips 110*a* and 110*b* and strips 140*a* and 140*b*. For T shaped intersection 660, T or similar shaped electrical/conductive connector member 670 (see FIG. 9) can be provided for electrical connection between strips 110*c* and 140*c* (or similar other strips) with strips 110*d* and 140*d*. In this perpendicular relationship between strips 110*c* and 140*c* with strips 110*d* and 140*d*, only one strip 110*d* or 140*d*, needs to be "jumped" over (i.e. insulated) to prevent shorting and the other connection between 110*c* or 140*c* with strips 110*d* or 140*d*, needs to be electrically connected similar to corner member 380 (i.e. without any insulated member) but with connector member 670 shaped different from the shape of corner member 380. Accordingly, a first T or similar shaped electrical connector 670 can be provided with an insulated portion 672 (i.e. similar to insulated portion 622 used with plus/cross shaped connector 620), whereas the second T or similar shaped electrical connector 670 does not contain insulated portion since no jump/crossover is needed for the connection created by second connector 670.

Figure 11:
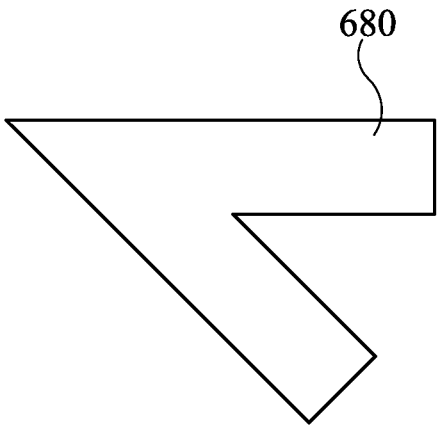
FIG. 11 illustrates a first additional and non-limiting angled overlapping member in accordance with the present disclosure that can be used similar to the corner member shown in FIG. 4 for non 90° turns/relationship between adjacent copper strips based on a particular copper strip pattern.
Figure 12:
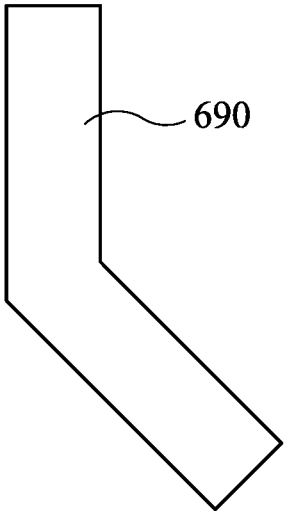
FIG. 12 illustrates a second additional and non-limiting angled overlapping member in accordance with the present disclosure.

FIGS. 11 and 12 illustrate additional non-limiting shaped conductive connector members 680 and 690, respectively, that can be used to connect adjacent conductive/copper strips 110 or 140 that are disposed at other angular relationships to each other. Conductive connector members 680 and 690 function (and can be constructed) similar to corner member 380 and are secured over the ends of conductive/copper strips 110/140 similar to that described above for corner member 380. Other angular relationships between adjacent strips 110 or 140 can also be provided and corresponding shaped electrical connector members can be provided for electrically connecting these adjacent strips and are also considered within the scope of the disclosure.

Preferably, corner member 380, plus/cross shaped electrical connector 620, T shaped electrical connector 670, connector member 680, connector member 690 and any other similar purposed conductive connector for electrically connecting adjacent conductive/copper strips (collectively referred to as "electrical connector") can be provided to achieve a "series" electrical connection between the adjacent conductive/copper strips. However, depending on the designed of the conductive strip pattern/lighting configurations, the electrical connector may be used to also create a "parallel" electrical connection between adjacent conductive/copper strips.

After removing guide tape 500 from the copper tape/strips 110 and 140 mounted on the intended surface, the strips 110 and 140 can be painted or left as is. Preferably, lights 180 and controller 220 are stuck on to copper tape/strips 110 and 140 without requiring any further mounting. Thus, the instruments preferably used for installing system 100 can be merely measuring tape, a pen/marker and scissors. Tape 500, along with attached strips 110 and 140 can be cut at an angle so that corner pieces or other shaped relationships can be formed between adjacent strips, with an optional yet preferred corner member 380, connector 620, connector 670 or other similar electrical connector disposed over the ends of the adjacent strips to ensure a proper electrical connection between the two strips 110/140.

As mentioned above, in addition to lights 180, other electrical accessories/modules can be used and secured in the above described connection/plug in configurations such as, without limitation, ceiling fans, speakers, USB charges, security cameras, etc., while still allowing the described system easy to use and plug and play.

Preferably, the conductive adhesive used and described above, can be a conductive acrylic adhesive though such is not considered limiting and other conductive adhesive materials can be used and are considered within the scope of the disclosure.

All components of the present disclosure lighting/electrical device system and their attachment locations, materials, angular relationships, conductive materials, light types, bulb types, sizes, shapes, attachment mechanisms, electrical connections, electrical communications, electrical circuitry, electrical devices (in lieu or in addition to lights), power sources, light controllers, remote types, dimensions, values, etc. discussed above or shown in the drawings, if any, are merely by way of example and are not considered limiting and other component(s) and their attachment locations, materials, angular relationships, conductive materials, light types, bulb types, sizes, shapes, attachment mechanisms, electrical connections, electrical communications, electrical circuitry, electrical devices (in lieu or in addition to lights), power sources, light controllers, remote types, dimensions, values, etc. currently known and/or later developed can also be chosen and used and all are considered within the scope of the disclosure.

Unless feature(s), part(s), component(s), characteristic(s) or function(s) described in the specification or shown in the drawings for a claim element, claim step or claim term specifically appear in the claim with the claim element, claim step or claim term, then the inventor does not consider such feature(s), part(s), component(s), characteristic(s) or function(s) to be included for the claim element, claim step or claim term in the claim when and if the claim element, claim step or claim term is interpreted or construed, whether during prosecution of this application or in litigation or similar proceeding. Similarly, with respect to any "means for" elements in the claims, the inventor considers such language to require only the minimal amount of features, components, steps, or parts from the specification to achieve the function of the "means for" language and not all of the features, components, steps or parts describe in the specification that are related or could be attributed to the function of the "means for" language.

While the disclosure has been described and disclosed in certain terms and has disclosed certain embodiments or modifications, persons skilled in the art who have acquainted themselves with the disclosure, will appreciate that it is not necessarily limited by such terms, nor to the specific embodiments and modification disclosed herein. Thus, a wide variety of alternatives, suggested by the teachings herein, can be practiced without departing from the spirit of the disclosure, and rights to such alternatives are particularly reserved and considered within the scope of the disclosure.

What is claimed is:

1. A surface mounted lighting system comprising:

a first copper strip;

a second copper strip, both the first copper strip and the second copper strip adapted for direct attachment to a wall or ceiling surface and are fully exposed after attachment to the wall or ceiling surface;

at least one LED light; each of the at least one LED light adhered to the first copper strip and the second copper strip at a desired surface location on the wall or ceiling surface within a room to provide an electrical connection between the at least one LED light and the first and second copper strips; and a controller adhered to the first copper strip and the second copper strip and providing power for energizing the at least LED light electrically connected to the first copper strip and the second copper strip, the controller having electronics or electrical circuitry for controlling operation of the at least one LED light.

2. The surface mounted lighting system of claim 1 wherein each LED light having a light housing with a front area and a back surface and a first contact member having a first conductive portion and a second contact member having a second conductive portion attached to the back surface of the light housing; wherein each LED light having one or more LED light bulbs visible from the front area and having electrical circuitry/electronics disposed within the light housing; wherein the electrical circuitry/electronics are in electrical communication with the first conductive portion of the first contact member and the second conductive portion of the second contact member; wherein the first conductive portion is in electrical communication with the first exposed copper strip and the second conductive portion is in electrical communication with the second exposed copper strip.

3. A surface mounted lighting system comprising:

a first copper strip;

a second copper strip;

at least one LED light; each of the at least one LED light adhered to the first copper strip and the second copper strip at a desired surface location on a wall or ceiling surface within a room to provide an electrical connection between the at least one LED light and the first and second copper strips; and a controller adhered to the first copper strip and the second copper strip and providing power for energizing the at least one LED light electrically connected to the first copper strip and the second copper strip, the controller having electronics or electrical circuitry for controlling operation of the at least one LED light;

wherein each LED light having a light housing with a front area and a back surface and a first contact member having a first conductive portion and a second contact member having a second conductive portion attached to the back surface of the light housing; wherein each LED light having one or more LED light bulbs visible from the front area and having electrical circuitry/electronics disposed within the light housing; wherein the electrical circuitry/electronics are in electrical communication with the first conductive portion of the first contact member and the second conductive portion of the second contact member; wherein the first conductive portion is in electrical communication with the first copper strip and the second conductive portion is in electrical communication with the second copper strip;

wherein the first contact member and the second contact member are multi-layered with multi-layers for both the first contact member and the second contact member comprising:

double sided foam tape having a first surface secured directly to the back surface of the light housing and an opposite second surface;

copper tape secured having a first surface secured directly to the second surface of the double sided foam tape; and a conductive adhesive disposed on a second surface of the copper tape;

wherein the LED light further comprising a first electrical wire having a first end disposed within the light housing and in electrical communication with the electrical circuitry/electronics also disposed within the light housing and a second end disposed outside of the light housing and sandwiched between the copper tape and the double sided foam tape of the first contact member;

wherein the LED light further comprising a second electrical wire having a first end disposed within the light housing and in electrical communication with the electrical circuitry/electronics and a second disposed outside of the light housing and sandwiched between the copper tape and the double sided foam tape of the second contact member;

wherein the first electrical wire creating electrical communication between the copper tape of the first contact member and the electrical circuitry/electronics of the LED light and the second electrical wire creating electrical communication between the copper tape of the second contact member and the electrical circuitry/electronics of the LED light.

4. The surface mounted lighting system of claim 1 wherein the controller having a controller housing with a back surface and a first contact member having a first conductive portion and a second contact member having a second conductive portion attached to the back surface of the controller housing; wherein the controller having electrical circuitry/electronics disposed within the controller housing; wherein the electrical circuitry/electronics are in electrical communication with the first conductive portion of the first contact member and the second conductive portion of the second contact member; wherein the first conductive portion is in electrical communication with the first copper strip and the second conductive portion is in electrical communication with the second copper strip.

5. A surface mounted lighting system comprising:

a first copper strip;

a second copper strip;

at least one LED light; each of the at least one LED light adhered to the first copper strip and the second copper strip at a desired surface location on a wall or ceiling surface within a room to provide an electrical connection between the at least one LED light and the first and second copper strips; and a controller adhered to the first copper strip and the second copper strip and providing power for energizing the at least one LED light electrically connected to the first copper strip and the second copper strip, the controller having electronics or electrical circuitry for controlling operation of the at least one LED light;

wherein prior to securing the first copper strip and the second copper strip to the desired surface, the system further comprises a length of guide tape adhered to a first surface of the first copper strip and the second copper strip; a nonconductive adhesive applied to a second surface of the first copper strip and the second copper strip; and a removable cover disposed over the nonconductive adhesive which is removed prior to securing of the first copper strip and the second copper strip to the desired surface by the nonconductive adhesive.

6. The surface mounted lighting system of claim 5 wherein once the first copper strip and second copper strip are secured to the desired surface by the nonconductive adhesive, the guide tape is removed to expose the first surface of the first copper strip and the first surface of the second copper strip for electrical connection to the at least one LED light.

7. The surface mounted lighting system of claim 5 wherein the first copper strip and the second copper strip are in a parallel or substantially parallel relationship to each other on the guide tape.

8. The surface mounted lighting system of claim 1 wherein the first copper strip and the second copper strip are in a parallel or substantially parallel relationship to each other along the desired surface.

9. The surface mounted lighting system of claim 1 further comprising at least one electrical connector for electrically connecting two adjacent copper strips; wherein the electrical connector is disposed over portions of the two adjacent copper strips to ensure a "series" electrical connection between the adjacent copper strips.

10. A surface mounted lighting system comprising:

a first copper strip;

a second copper strip; said second copper strip disposed at a substantially parallel relationship with the first copper strip along a desired surface of a wall or ceiling within a room;

at least one LED light; each of the at least one LED light adhered to the first copper strip and the second copper strip at a specific location on the desired surface to provide an electrical connection between the at least one LED light and the first and second copper strips; wherein each LED light having a light housing with a front area and a back surface and a first contact member having a first conductive portion and a second contact member having a second conductive portion attached to the back surface of the light housing; wherein each LED light having one or more LED light bulbs visible from the front area and having electrical circuitry/electronics disposed within the light housing; wherein the electrical circuitry/electronics are in electrical communication with the first conductive portion of the first contact member and the second conductive portion of the second contact member;

wherein the first contact member and the second contact member attached to back surface of the light housing are multi-layered with multi-layers for both the first contact member and the second contact member comprising (a) double sided foam tape having a first surface secured directly to the back surface of the light housing and an opposite second surface; (b) copper tape secured having a first surface secured directly to the second surface of the double sided foam tape; and (c) a conductive adhesive disposed on a second surface of the copper tape;

wherein the LED light further comprising a first electrical wire having a first end disposed within the light housing and in electrical communication with the electrical circuitry/electronics also disposed within the light housing and a second end disposed outside of the light housing and sandwiched between the copper tape and the double sided foam tape of the first contact member;

wherein the LED light further comprising a second electrical wire having a first end disposed within the light housing and in electrical communication with the electrical circuitry/electronics and a second disposed outside of the light housing and sandwiched between the copper tape and the double sided foam tape of the second contact member;

wherein the first electrical wire creating electrical communication between the copper tape of the first contact member and the electrical circuitry/electronics of the LED light and the second electrical wire creating electrical communication between the copper tape of the second contact member and the electrical circuitry/electronics of the LED light; and a controller adhered to the first copper strip and the second copper strip and providing power for energizing the at least one LED light electrically connected to the first copper strip and the second copper strip, the controller having electronics or electrical circuitry for controlling operation of the at least one LED light; wherein the controller having a controller housing with a back surface and a first contact member having a first conductive portion and a second contact member having a second conductive portion attached to the back surface of the controller housing; wherein the controller having electrical circuitry/electronics disposed within the controller housing; wherein the electrical circuitry/electronics are in electrical communication with the first conductive portion of the first contact member and the second conductive portion of the second contact member; wherein the first conductive portion is in electrical communication with the first copper strip and the second conductive portion is in electrical communication with the second copper strip;

wherein the first conductive portion is in electrical communication with the first copper strip and the second conductive portion is in electrical communication with the second copper strip to allow the LED light to be controlled by the controller.

11. The surface mounted lighting system of claim 1 further comprising a first adhesive member provided on an attachment surface of the first copper strip for directly attaching the first copper strip to the wall or ceiling surface and a second adhesive member provided on an attachment surface of the second copper strip for directly attaching the second copper strip to the wall or ceiling surface.

12. The surface mounted lighting system of claim 1 further comprising:

a third copper strip;

a fourth copper strip, both the third copper strip and the fourth copper strip adapted for direct attachment to the wall or ceiling surface and are fully exposed after attachment to the wall or ceiling surface;

a first overlapping copper strip having a first section and a second section, the first section of the first overlapping copper strip electrically connected to the first copper strip and the second section of the first overlapping copper strip electrically connected to the third copper strip to provide electrical communication between the first copper strip and the third copper strip; and a second overlapping copper strip having a first section and a second section, the first section of the second overlapping copper strip electrically connected to the second copper strip and the second section of the second overlapping copper strip electrically connected to the fourth copper strip to provide electrical communication between the second copper strip and the fourth copper strip.

13. The surface mounted lighting system of claim 12 wherein the first section and the second section of the first overlapping copper strip positioned in a permanent non-90° angular relationship with respect to each other and the first section and the second section of the second overlapping copper strip positioned in a permanent non-90° angular relationship with respect to each other.

14. The surface mounted lighting system of claim 13 wherein the angular relationship for the sections of the first overlapping copper strip and the angular relationship for the sections of the second overlapping copper strip are both smaller than 90°.

15. The surface mounted lighting system of claim 13 wherein the angular relationship for the sections of the first overlapping copper strip and the angular relationship for the sections of the second overlapping copper strip are both larger than 90°.

16. The surface mounted lighting system of claim 12 wherein the first section and the second section of the first overlapping copper strip positioned in a 90° or substantially 90° angular relationship with respect to each other and the first section and the second section of the second overlapping copper strip positioned in a 90° or substantially 90° angular relationship with respect to each other.

17. The surface mounted lighting system of claim 13 wherein the angular relationship for the sections of the first overlapping copper strip and the angular relationship for the sections of the second overlapping copper strip are the same.

18. The surface mounted lighting system of claim 1 further comprising clear or transparent guide tape secured to the first copper strip and the second copper strip that is removed after the first copper strip and the second copper strip are attached to the wall or ceiling surface.

19. The surface mounted lighting system of claim 1 further comprising an amount of conductive adhesive for securing and electrically connecting the at least one LED light to the first copper strip and the second copper strip.

20. The surface mounted lighting system of claim 1 further comprising an amount of conductive adhesive for securing and electrically connecting the controller to the first copper strip and the second copper strip.

* * * * *